US009139329B2

(12) United States Patent
Thomann et al.

(10) Patent No.: US 9,139,329 B2
(45) Date of Patent: Sep. 22, 2015

(54) TEMPORARY BUNDLING OF SMALL WIDTH CASES

(75) Inventors: Helmut Peter Thomann, Schwalbach am Taunus (DE); Ibrahim Ulas, Steinbach am Taunus (DE); Julia Vohwinkel, Kronberg im Taunus (DE)

(73) Assignee: The Procter & Gamble Company, Cincinnati, OH (US)

( * ) Notice: Subject to any disclaimer, the term of this patent is extended or adjusted under 35 U.S.C. 154(b) by 134 days.

(21) Appl. No.: 12/970,070

(22) Filed: Dec. 16, 2010

(65) Prior Publication Data

US 2011/0147388 A1 Jun. 23, 2011

(30) Foreign Application Priority Data

Dec. 23, 2009 (EP) ..... 09015913

(51) Int. Cl.

| | |
|---|---|
| ***A47G 19/00*** | (2006.01) |
| ***B65D 5/00*** | (2006.01) |
| ***B65D 43/02*** | (2006.01) |
| ***B65D 5/42*** | (2006.01) |
| ***B65B 17/02*** | (2006.01) |

(52) U.S. Cl.

CPC ..... *B65D 5/4275* (2013.01); *B65B 17/02* (2013.01)

(58) Field of Classification Search

CPC ..... B65D 5/5495; B65D 5/4275; A61J 1/03; B65B 17/02

USPC ..... 229/120.011, 120.01, 123.1, 123.2; 220/23.4, 23.2, 507, 23.6; 206/504, 206/521.15

See application file for complete search history.

(56) References Cited

U.S. PATENT DOCUMENTS

| | | | | | |
|---|---|---|---|---|---|
| 3,127,991 | A * | 4/1964 | Burnett | 206/499 |
| 3,322,323 | A * | 5/1967 | Greene et al. | 229/136 |
| 3,912,157 | A * | 10/1975 | Graser | 206/434 |
| 4,913,291 | A * | 4/1990 | Schuster | 229/120.011 |
| 5,597,114 | A * | 1/1997 | Kramedjian et al. | 229/122.1 |
| 6,974,033 | B2 * | 12/2005 | McLeod et al. | 206/736 |
| 7,059,494 | B2 * | 6/2006 | Harrelson et al. | 221/92 |
| 2003/0217937 | A1 * | 11/2003 | Wilder et al. | 206/264 |

FOREIGN PATENT DOCUMENTS

| | | | | |
|---|---|---|---|---|
| DE | 27 49 941 | A1 | 5/1979 | |
| DE | 196 04 563 | A1 | 8/1997 | |
| EP | 0 408 900 | A1 | 1/1991 | |
| EP | 0 631 946 | A1 | 1/1995 | |
| EP | 1 864 913 | A1 | 12/2007 | |
| EP | 09172685 | * | 9/2009 | B65D 5/00 |

OTHER PUBLICATIONS

European Search Report, mailed Mar. 19, 2010, 6 pages.

* cited by examiner

*Primary Examiner* — Shawn M Braden

(74) *Attorney, Agent, or Firm* — Andres E. Velarde

(57) ABSTRACT

A bundle comprising two or more cases, each case having a width and a length. The cases are releasably attached together along at least one twisting axis. The cases can be detached by being twisted apart along the twisting axis, and the width of each case is from 50 mm to 200 mm. A method of bundling together two cases along a twisting axis by attaching the cases is also disclosed.

9 Claims, 9 Drawing Sheets

TEMPORARY BUNDLING OF SMALL WIDTH CASES

FIELD OF THE INVENTION

The present invention is in the field of packaging, in particular the invention relates to the temporary bundling of individual cases having a relatively small width to facilitate the handling, storage and transport (palletizing) of these cases.

BACKGROUND OF THE INVENTION

Manufactured products such as diapers or sanitary pads are usually transported from the site of production to the point of sale in cases, usually designated as secondary packages, containing several of the carton boxes or plastic wraps that are presented to the consumers, the so called primary packages.

Shelf-ready secondary packages are increasingly being used because they allow the supermarket staff to place several products in one movement on the shelf instead of having to place each primary packages separately. Examples of shelf-ready packages are the so called tray-and-hood packages, wherein the primary packages are placed in a tray which can be placed directly on the shelf. A hood is placed within the tray during transport and storage to protect the products, and is normally discarded by the supermarket staff before placing the tray on the shelf. These packages provide an excellent protection for relatively unstable or fragile products, for example hygiene products such as diapers or feminine sanitary products packaged in a carton box or a plastic wrap.

Secondary packages usually have a width larger than 15 cm, especially for absorbent hygiene products such as diapers or feminine sanitary articles. Since many secondary packages are shelf-ready packages, the width of the package is usually the width of the space occupied by the products on the shelf. However shelf space is limited, so it may be a customer (the supermarket) requirement to the manufacturer of the products to provide secondary packages with a smaller width, for example by packing only one row of products in the shelf-depth direction instead of two as may be the case for products having a relatively small width, e.g. feminine sanitary products.

Although secondary packages can be made with a smaller width, these packages are less stable and require a handling (e.g. palletizing) system with higher capacity for the same amount of products. Furthermore it is also desirable that an untrained supermarket staff should be able to easily and intuitively place the products on the shelf without using a cutting implement such as a cutter or knife in order to avoid causing damages to the products or injuries to the staff.

SUMMARY OF THE INVENTION

In order to solve the above mentioned problems, the inventors have come to the insight that cases with a smaller than usual width of from 50 mm to 200 mm, and in particular of from 75 mm to 150 mm, could be releasably attached together to provide a bundle having a larger width, providing easier handling, storage and transport.

The bundles of the invention, as indicated in the claims, comprise two or more cases. The cases are releasably attached together by attachment means defining a twisting axis. The cases can be detached by being twisted apart along the twisting axis, for example by a supermarket attendant. The invention is also for a process for bundling two cases into a bundle, as indicated in the claims.

FIG. **9*a*-9*f*** shows a schematic diagram of an exemplary process for attaching the two cases into a bundle.

DETAILED DESCRIPTION OF THE INVENTION

While the specification concludes with claims which particularly point out and distinctly claim the invention, it is believed the present invention will be better understood from the following description of exemplary embodiments taken in conjunction with the accompanying drawings.

Figure 1:
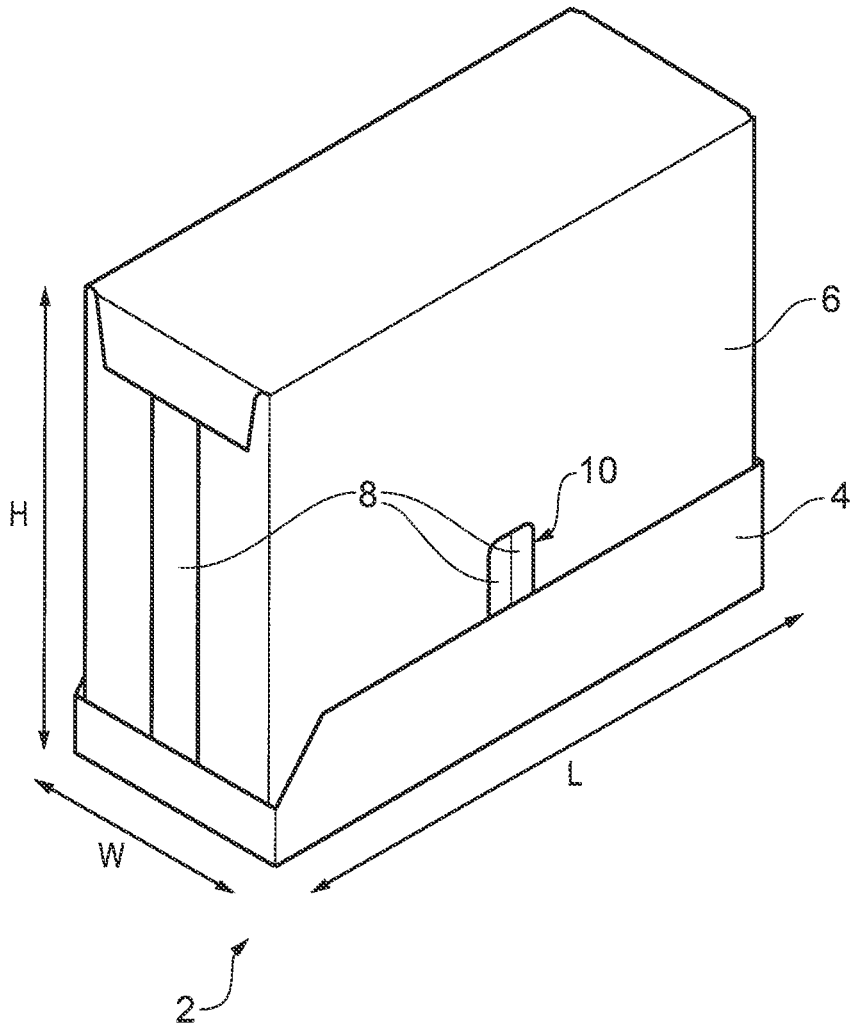
FIG. 1 is a perspective view of an exemplary case having a relatively small width.

FIG. 1 is a perspective view of an exemplary case 2 that can be used to make a bundle 20 according to the invention. Although a tray-and-hood type case is shown and described herein, other types of cases may be used within the present invention, for example as fully enclosed carton case. However shelf-ready packages are nowadays widely used, so that the invention will be exemplarily described herein in relation to shelf-ready cases.

The case 2 has a width W, a height H and a length L. For shelf-ready packages, the width can be easily defined as the dimension in the horizontal plane of the front side of the case (i.e. the side that is presented to the buyer when the product is placed on the shelf), the length is the dimension of the case in the horizontal plane perpendicular to the width and the height is the vertical dimension of the case. In general, the width is usually the dimension of the smallest side of the case, the length the dimension of the longest side of the article and the height its third dimension. The length of the case may be chosen to be approximately equal or slightly smaller than the depth of the intended shelf. The length may be for example of from 30 cm to 80 cm. The width of the case is relatively small, being from 50 mm to 200 mm, or advantageously less, in particular from 75 mm to 150 mm. The height will of course be adapted to the products packaged in the case, for example from 10 cm to 30 cm. The invention is also especially useful with cases which width represents about half their height or less, as these may be particularly instable.

The case exemplarily represented in the Figures comprises a tray 4 and a hood 6 placed within the tray 4. The products 8 are placed within the tray 4. The hood may be releasably attached to the tray. Tray and hood cases are described for example in EP1,864,913, U.S. Pat. No. 5,447,225, U.S. Pat. No. 5,505,369 and co-pending European application EP09172685. The hood is normally removed or detached from the tray and then discarded by the supermarket staff when the shelves are replenished. For example, the hood and the tray may be attached by a glue spot (not shown) placed under an opening 10 placed on each lateral side of the case. The opening 10 allows the user to place his fingers between the tray and the hood and break the glue seal, thus releasing the hood. Although the case shown in the Figures is a tray-and-hood type case, the principle of the invention is of course applicable to other type of cases, for example one piece fully closed cases.

In an embodiment, the tray has a bottom panel and the hood has a top panel and at least two inner side panels. When no load is applied on the top panel, a gap separates the products from the top panel. When a load of 1.50 N/cm$^2$ is applied uniformly on the top panel, the inner side panels bend inwardly towards the products, so that the inner side panels come in contact with the products without the top panel coming in contact with the products.

For the present invention, where the case has a relatively small width, it is expected that the one product at a time would normally be facing the buyer, so that the products may be placed in a single line along the length of the tray. The tray may be printed with decoration and/or indication of the products contained therein. The hood is normally not decorated, but information about the products may be indicated, such as bar code or a written description of the content.

Figure 2:
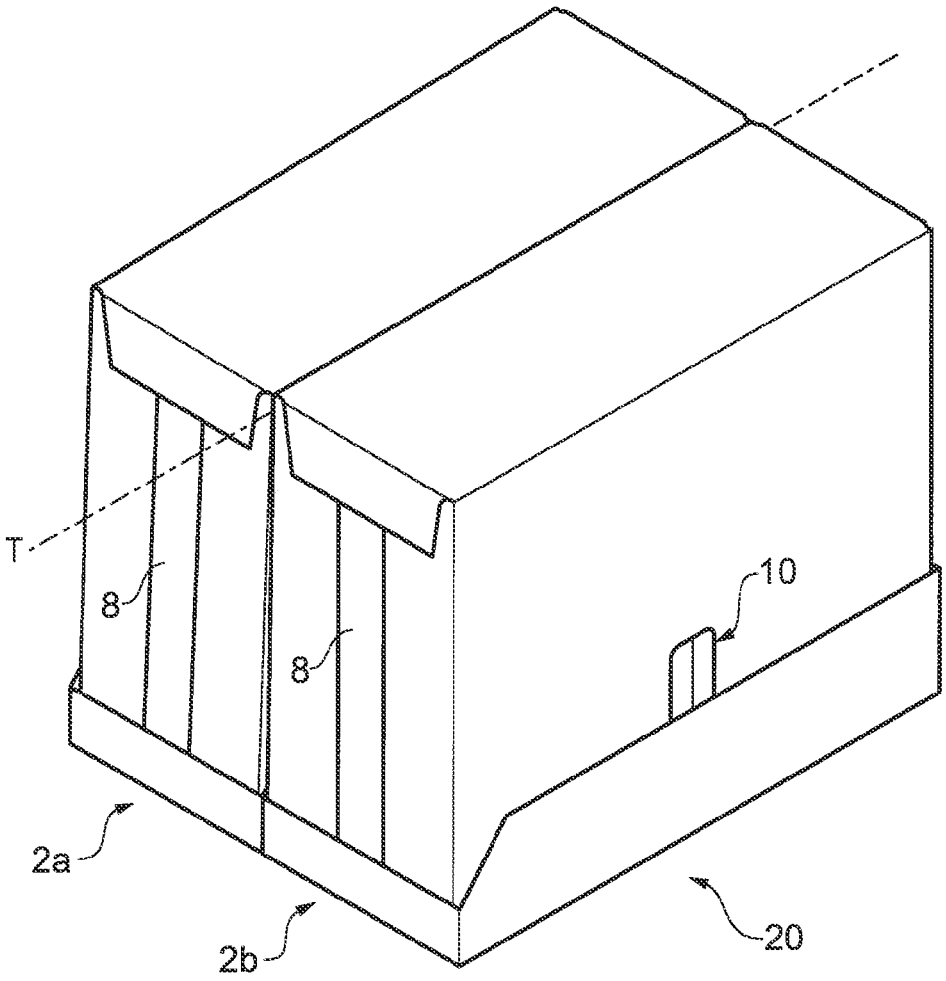
FIG. 2 is a perspective view of an exemplary bundle of the present invention comprising two cases as shown on FIG. 1.

FIG. 2 is a perspective view of an exemplary bundle 20 of the present invention where two cases 2*a*, 2*b* identical to the one of FIG. 1 have been releasably attached together. The cases may be identical, i.e. may be of the same dimensions and contain the same products. If desired, the first case may of course comprise different products than the second case. The cases may have different dimensions, however having cases of identical dimensions provides easier handling. Although exemplarily represented as a bundle of two cases, three or more cases may be bundled together.

Figure 3:
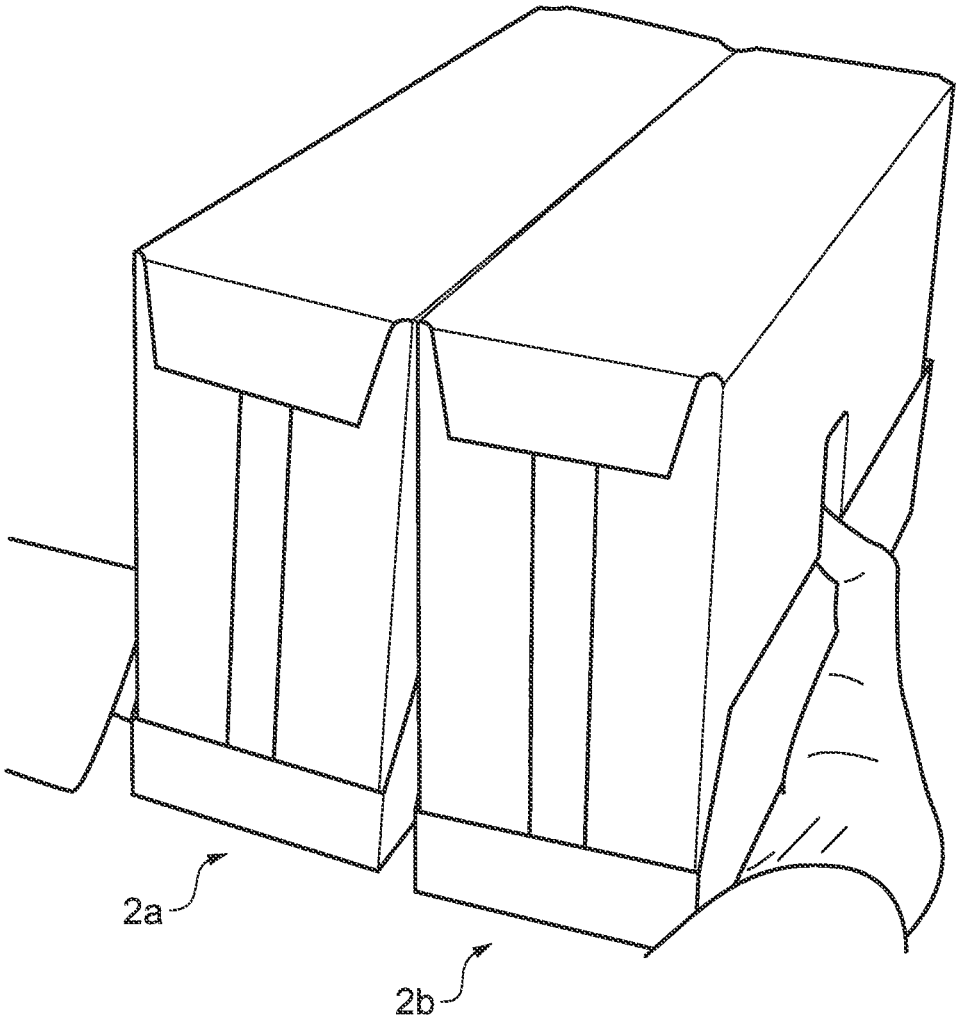
FIG. 3 is a perspective view of the exemplary bundle of FIG. 2 wherein the cases are in the process of being twisted apart by a manipulator.

The cases are releasably attached together by attachment means 12*a* defining at least one twisting axis T which will be used intuitively by a manipulator to detach the cases when needed. The attachment means may be exemplarily provided by at least two glue spots 12*a*, 12*b*, defining a twisting axis T as shown on FIG. 5. FIG. 3 shows a manipulator starting to twist apart the cases. Further twisting breaks the attachment means and causes the two cases to detach as shown on FIG. 4.

Figure 5:
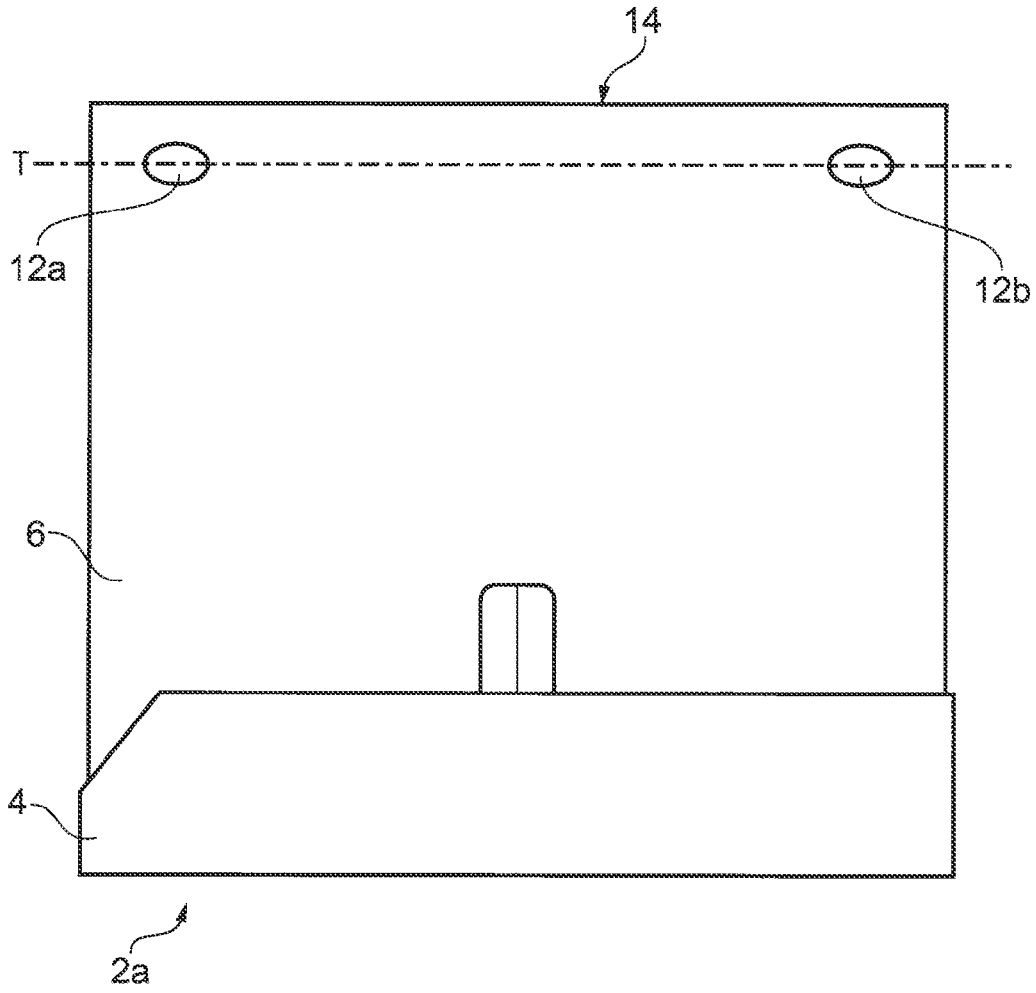
FIG. 5 shows a view of the side of one of the case showing attachment means in the form of two glue spots.

The twisting axis T may be placed proximal one of the side corner 14 of each case, as shown on FIG. 5, advantageously one of the length corner of each case. For example, the attachment means may be placed such that the twisting axis is at a distance of from 0 mm to 30 mm, in particular 1 mm to 20 mm, of one of the corner side of each of the cases. This way, the manipulator can easily grab the opposite corners of the cases and use them to twist the cases along the twisting axis until the attachment means breaks.

As shown in the Figures, the attachments means may be advantageously placed such that the twisting axis is orientated in the same direction as the length of the cases. All these advantageous features provide improved attachment means because they lead the manipulator to grab the sides of the cases opposite the twisting axis and intuitively break the attachment means by twisting the cases apart. Some examples of attachment means will now be described in more details.

Figure 4:
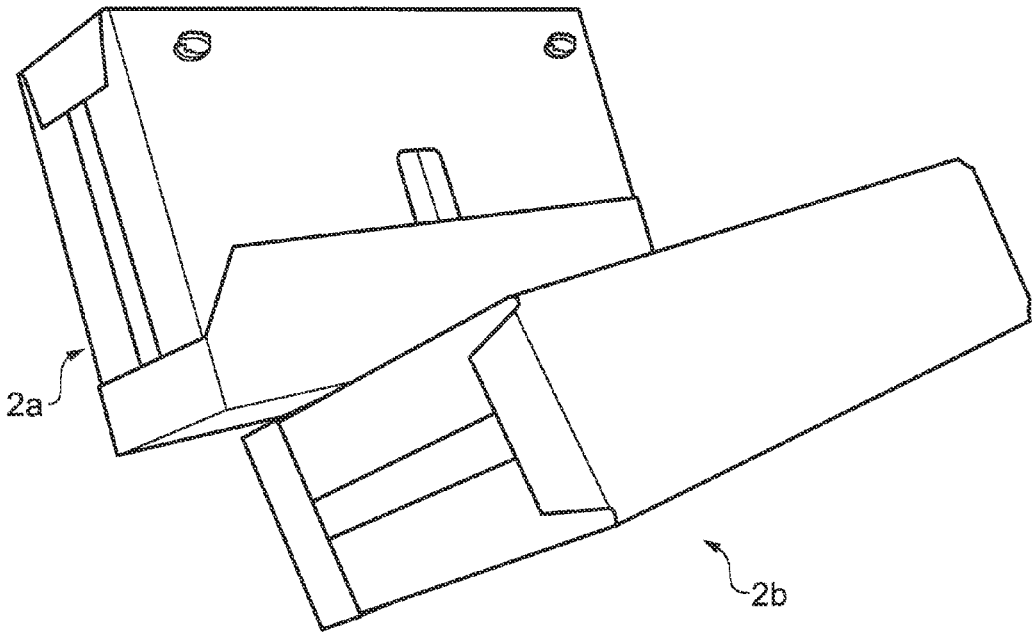
FIG. 4 is a perspective view of the exemplary bundle of FIG. 2 wherein following further twisting the cases have been detached from another.

In one embodiment, the attachment means comprises two or more aligned glue spots, as exemplary shown on FIGS. 4 and 5. The line passing through the center of the two or more aligned spots defines a twisting axis along which the cases can be easily and intuitively twisted until the glue spots break and the cases are detached. The center of a glue spot is herein defined as the geometric center of its area. In the example shown on FIG. 5 the glue spots are of elliptical shapes, as would be seen just after application and before attachment. As shown on FIG. 4, when the cases are separated, usually part of the carton is torn apart on one of the case and remains on the other side. The shape of the glue spot(s) in the plane of application is not critical, for example the shape may be chosen to be a rectangle, a square, a circle or an ellipse etc.

Figure 6:
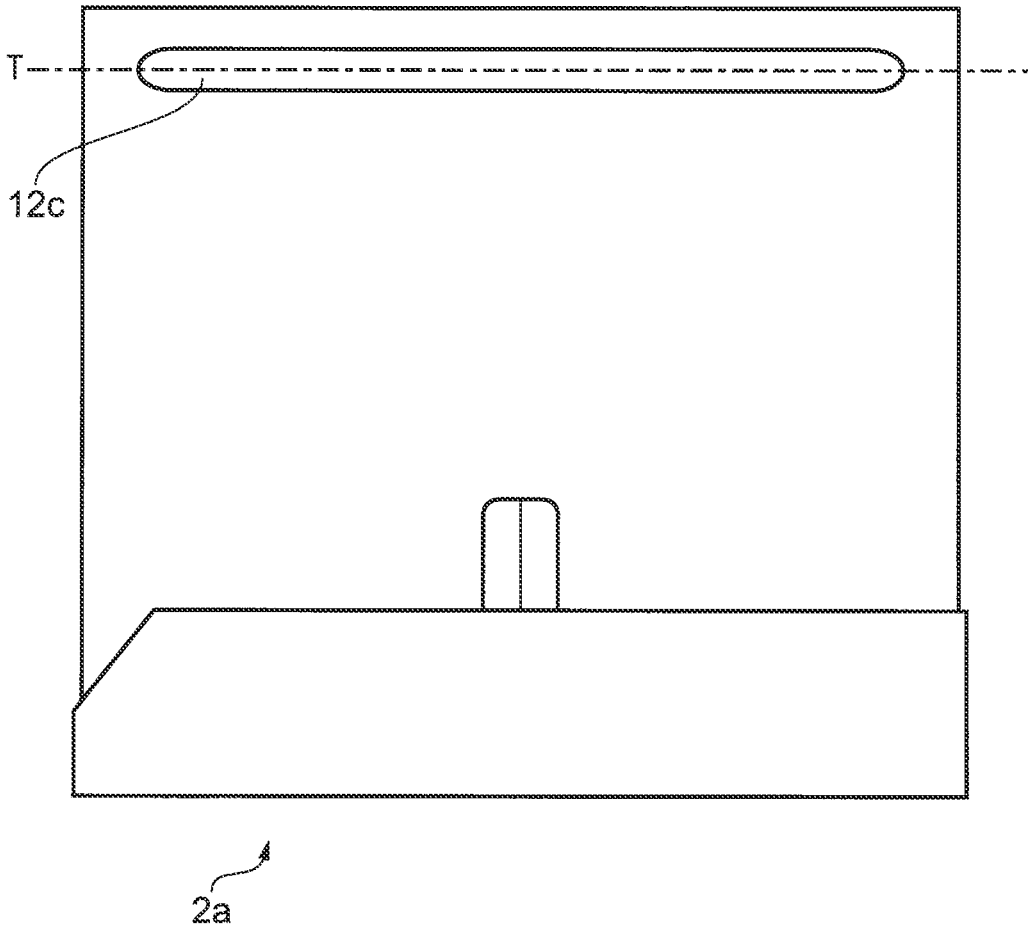
FIG. 6 shows a side view of the side of one of the case showing attachment means in the form of a glue stripe.

In another embodiment, a single glue spot 12*c* in the form of a stripe may be used, as exemplary shown on FIG. 6. The stripe may be in the form of an elongated rectangle for example. A stripe is hereby defined as a generally rectangular shape having a length at least three times longer than its width. Usually a stripe will have generally square corners, wherein in some embodiment the longitudinal ends can be slightly rounded as shown on FIG. 6. The twisting axis may then be defined as the line going through the geometric center of the stripe and orientated in the direction of the length of the stripe.

Figure 7:
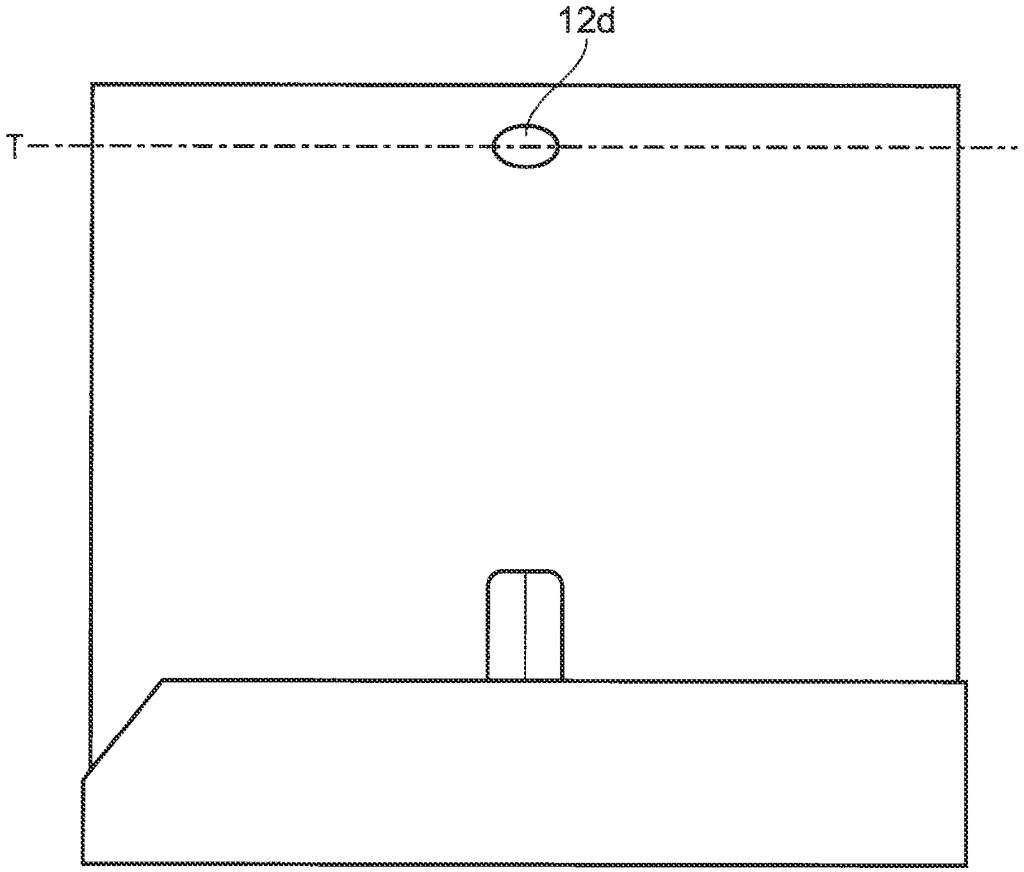
FIG. 7 shows a side view of the side of one of the case showing attachment means in the form of a single glue spot.

In another embodiment, a single glue spot 12*d* which is not in the form of a stripe, for example a rectangle, a square, a circle or an ellipse may be considered, as exemplary shown on FIG. 7. In this case, an infinite number of twisting axis passing through the glue spot in the plane of application may theoretically be defined. In practice, the manipulator will naturally twist the cases apart in the same way as the other embodiments shown above using a line parallel to the side of the cases closest to this single glue spot as twisting axis.

Any suitable pressure sensitive glue may be used to form the glue spots, for example a hot melt glue such as a silicone based glue. In one embodiment, it may be considered advantageous to use a glue having a temporary strength (i.e. where the adhesive strength of the glue decays with time), so that after a given time (e.g. after a few days) the eases separate automatically or are much easier to twist apart.

Other placements of the glue spots than those shown in the Figures may of course be used. For example the attachment means, e.g. glue spot(s), may be placed on the tray 4 instead of, or in addition to, the hood 6. The glue spots may also be placed in a vertical alignment to create a vertical twisting axis proximal one of the vertical corner of the cases, or may be placed proximal one of the corner side of the bottom of the cases, i.e. on the tray for tray-and-hood type cases. However, with cases of the tray-and-hood type, it may be advantageous to place the glue spot on the hood for aesthetic reasons, so that the glue spots on one case, and the respective tearing marks on the other case are not visible to the buyer when the trays are placed on the shelf.

Figure 8:
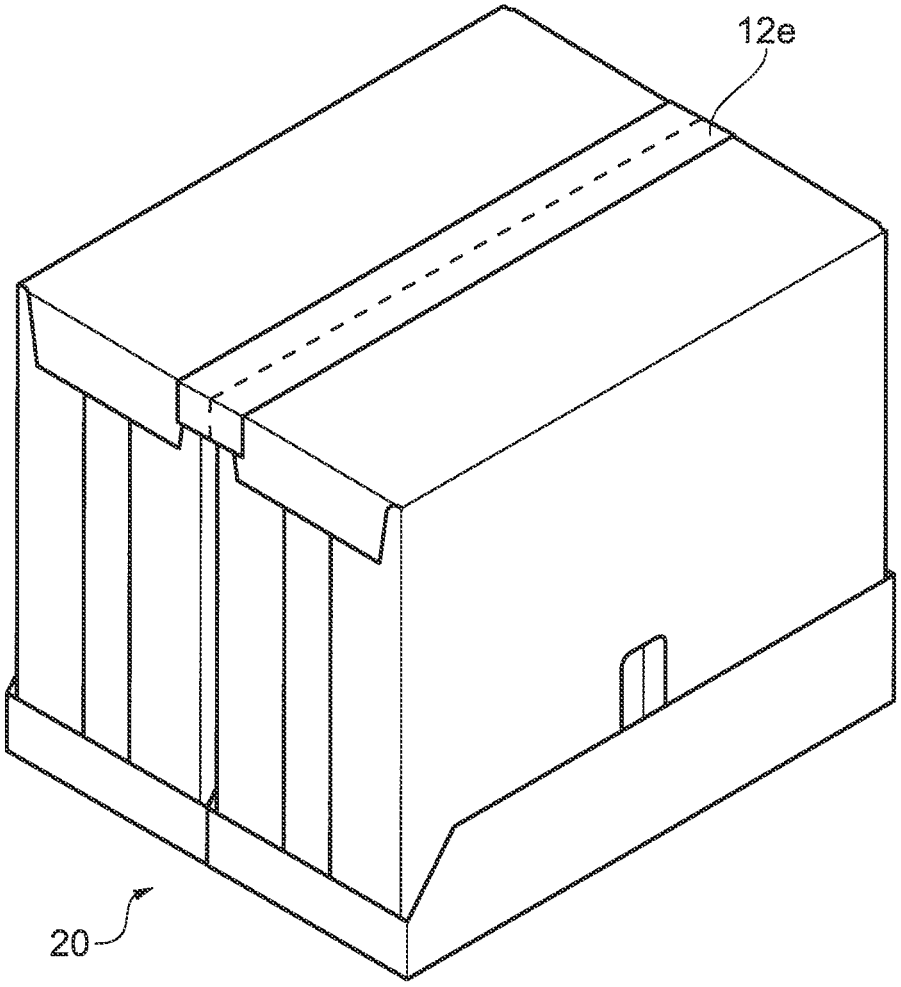
FIG. 8 shows a perspective view of an exemplary bundle of the present invention wherein the attachment means comprises a pre-perforated band attaching the two cases.

In another embodiment, instead of glue spots, an adhesive band 12*e* which may be perforated can be used as attachment means. The twisting axis is then defined by the length of the band, and/or the perforation line if present. This is exemplarily shown on FIG. 8.

Other attachment means may be considered, for example a "hook and loop" (e.g. Velcro®) system, where one component (e.g. the hooks) is fixed on one case and the other component (e.g. the loops) is fixed on the other case.

The attachment means may be placed on the cases using conventional techniques. For example, glue spots may be applied using a standard gluing machine on the desired emplacement on one case, and then pushing another case against it so that both cases are pressed together and the cases become attached by gluing. If an adhesive tape (e.g., perforated) is used, it can be simply unrolled and adhered along the length of the cases in a conventional manner so that it overlaps its side corners. Of course it may be advantageous to make this process automatic, but the attachment means may also be placed by hand to avoid capital cost if desired.

Figure 9A:
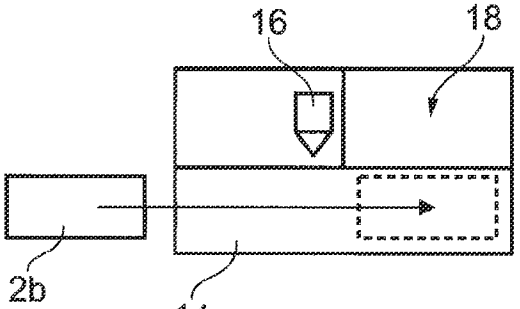
Figure 9B:
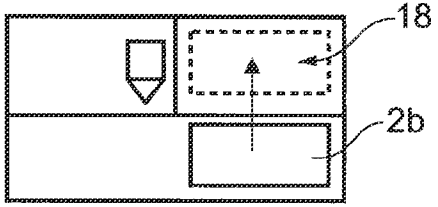
Figure 9C:
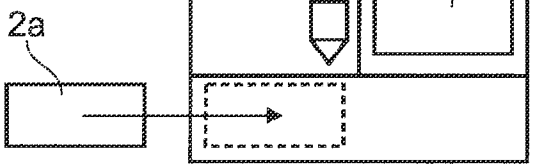
Figure 9D:
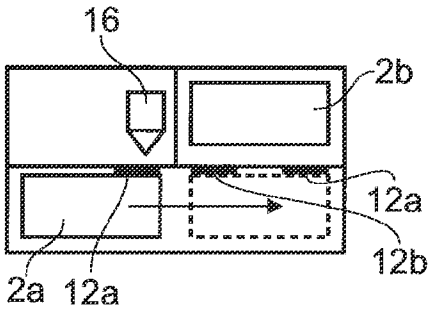
Figure 9E:
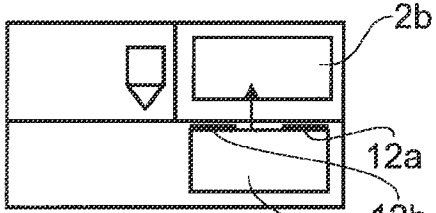
Figure 9F:
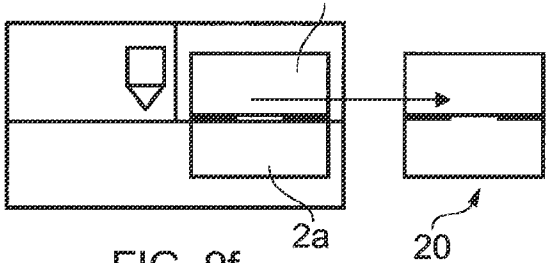

FIG. 9*a*-9*f* describes an embodiment of an exemplary process that was developed to apply attachment means, in particular one or more glue spots in an efficient way. The bundling equipment comprises a conveyor belt 14 on which the cases are provided, as is known in the art, and as shown in FIG. 9*a*. As the first case 2*b* is provided on the conveyor belt 14, it passes the gluing station equipped with the glue gun 16 and is placed in an offset, waiting position 18 by a pusher (not shown) relative to the conveyor belt (FIG. 9*b*). The second case 2*a* is provided on the conveyor belt 14 (FIG. 9*c*) and the attachment means 12*a*, 12*b* (e.g. glue spot(s)) are applied, in this example by the glue gun 16 at the gluing station (FIG. 9*d*). The second case 2*a* is then brought along the conveyor belt in a side to side relation with the first case 2*b* placed in the offset, waiting position 18 (FIG. 9*e*). A pusher (not shown) then brings the first case 2*b* in contact with the second case 2*a* so that both cases become attached via the glue spots (FIG. 9*f*). Depending on the glue type, a contact of 1s to 3s may be sufficient for the cases to be attached into a bundle 20 via the glue spots. The bundle 20 can then be conveyed away along the conveyor belt, for example to a storage room or palletizing unit. The whole bundling unit (not including the conveyor belt) may be placed on an elevator so it can be easily put out of the way if it is needed. Of course this example may be adapted for other attachment means such as the perforated adhesive band shown on FIG. 8, wherein the gluing station can be replaced by an adhesive band application station as known in the art.

As indicated above, bundling two relatively small cases has the advantage to provide a packaging of more standard size, which is easier to manipulate in standard production lines. In addition, the inventors have found that the bundles of the invention help stabilizing the pallets on which they are loaded for transport. For example, the bundle can be stacked in a columnar pattern on a pallet, whereas the single cases would require alternated stacking to avoid cases to fall down when the stretch foil is released. It is conjectured that bundling the relatively small cases together provide improved rigidity compared to non bundled cases.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A bundle comprising two or more cases, each case having a width, a height, a length, an upper surface, and a lower surface, each case containing a plurality of products, wherein the two or more cases each consists of a tray and a hood and are releasably attached together by glue comprising one of two or more aligned glue spots and a single glue spot, wherein the glue spot is in the form of a one of a stripe, or a single glue spot which is not in the form of a stripe, wherein the glue defines a twisting axis, wherein the two or more cases can be detached by being twisted apart along said twisting axis, wherein the width of each case is from 50 mm to 200 mm, wherein the tray of each case is releasably attached to its respective hood, and the hood of each case is releasably attached to its respective tray, wherein each hood is placed within its respective tray, wherein each case does not contain glue on the case upper surface or on the case lower surface; wherein the tray comprises a bottom panel, wherein the hood comprises a top panel and at least two inner side panels, and wherein:

when no load is applied on the top panel, a gap separates the products from the top panel, and when a load of about 1.50 N/cm$^2$ is applied uniformly on the top panel, the inner side panels bend inwardly towards the products, so that the inner side panels come in contact with the products without the top panel coming in contact with the products.

2. A bundle according to claim 1, wherein the twisting axis is orientated in the same direction as the length of the two or more cases.

3. A bundle according to claim 1, wherein the twisting axis is proximal to a corner side of each of the two or more cases.

4. A bundle according to claim 3, wherein the twisting axis is placed at a distance of up to 30 mm, of one of the corner side of each of the two or more cases.

5. A bundle according to claim 1 wherein the glue defining a twisting axis is placed on the hood.

6. A bundle according to claim 1, wherein the length, the width, and the height of the two or more cases are identical.

7. A bundle according to claim 1, wherein each case comprises several primary packages.

8. A bundle according to claim 7, wherein the primary packages are carton boxes or plastic wraps containing feminine hygiene products.

9. A bundle according to claim 1, wherein the hood of each case is releasably attached to its respective tray by a glue spot placed under an opening on each lateral side of the respective case.

* * * * *